United States Patent [19]

Forrest

[11] Patent Number: 4,849,864

[45] Date of Patent: Jul. 18, 1989

[54] ADJUSTABLE LIGHTING ASSEMBLY

[76] Inventor: Louis Forrest, 781 Palmer Rd., Bronxville, N.Y. 10708

[21] Appl. No.: 102,401

[22] Filed: Sep. 29, 1987

[51] Int. Cl.[4] ..... F21S 3/02

[52] U.S. Cl. ..... 362/225; 362/250; 362/427; 40/559

[58] Field of Search ..... 362/217, 220, 222, 225, 362/245, 250, 418, 426, 427, 273, 17, 18; 40/559–562, 624, 65

[56] References Cited

U.S. PATENT DOCUMENTS

| | | | |
|---|---|---|---|
| 1,744,369 | 1/1930 | Dietz et al. | 362/18 X |
| 2,131,795 | 10/1938 | Davidson | 40/561 |
| 2,382,878 | 8/1945 | Holelek | 362/220 |
| 2,746,187 | 5/1956 | Enneyer | 40/624 |
| 2,876,338 | 3/1959 | Seligson | 362/18 |
| 2,964,616 | 12/1960 | Seidman | 362/217 |
| 3,062,952 | 11/1962 | Harling | 362/418 |
| 3,108,751 | 10/1963 | Rodmaker et al. | 362/427 |
| 3,712,978 | 1/1973 | Lowell | 362/18 X |
| 4,118,766 | 10/1978 | Kredo | 362/427 |
| 4,204,274 | 5/1980 | Luderitz | 362/239 |
| 4,338,653 | 7/1982 | Marrero | 362/223 |
| 4,449,169 | 5/1984 | Warshawsky | 362/250 X |
| 4,464,707 | 8/1984 | Forrest | 362/222 |
| 4,528,618 | 7/1985 | Bitsch | 362/220 X |

*Primary Examiner*—Ira S. Lazarus
*Assistant Examiner*—Richard R. Cole
*Attorney, Agent, or Firm*—Epstein & Edell

[57] ABSTRACT

A versatile outdoor lighting and/or display assembly provides for maximal positional adjustability of individual fixtures and permits the size and directivity of the light-emitting openings of the fixtures to be selectively changed. In one embodiment the assembly includes two linear reflected lighting fixtures mounted with their axes in fixed spaced parallel relation, each of the fixtures being independently rotatable through a complete 360° range. In a second embodiment, a first linear reflected lighting fixture is mounted on a second linear reflected lighting fixture such that the first fixture is selectively rotatable about three mutual transverse axes and is selectively translatable along the length dimension of the second fixture. The light-emitting openings of the fixtures can be varied in size and directivity by means of deflectors mounted along the longitudinal edges of the fixture reflector, the deflectors being oriented to diverge at angles appropriate to achieve the desired size of the enlarged light-emitting opening.

23 Claims, 6 Drawing Sheets

FIG. 1
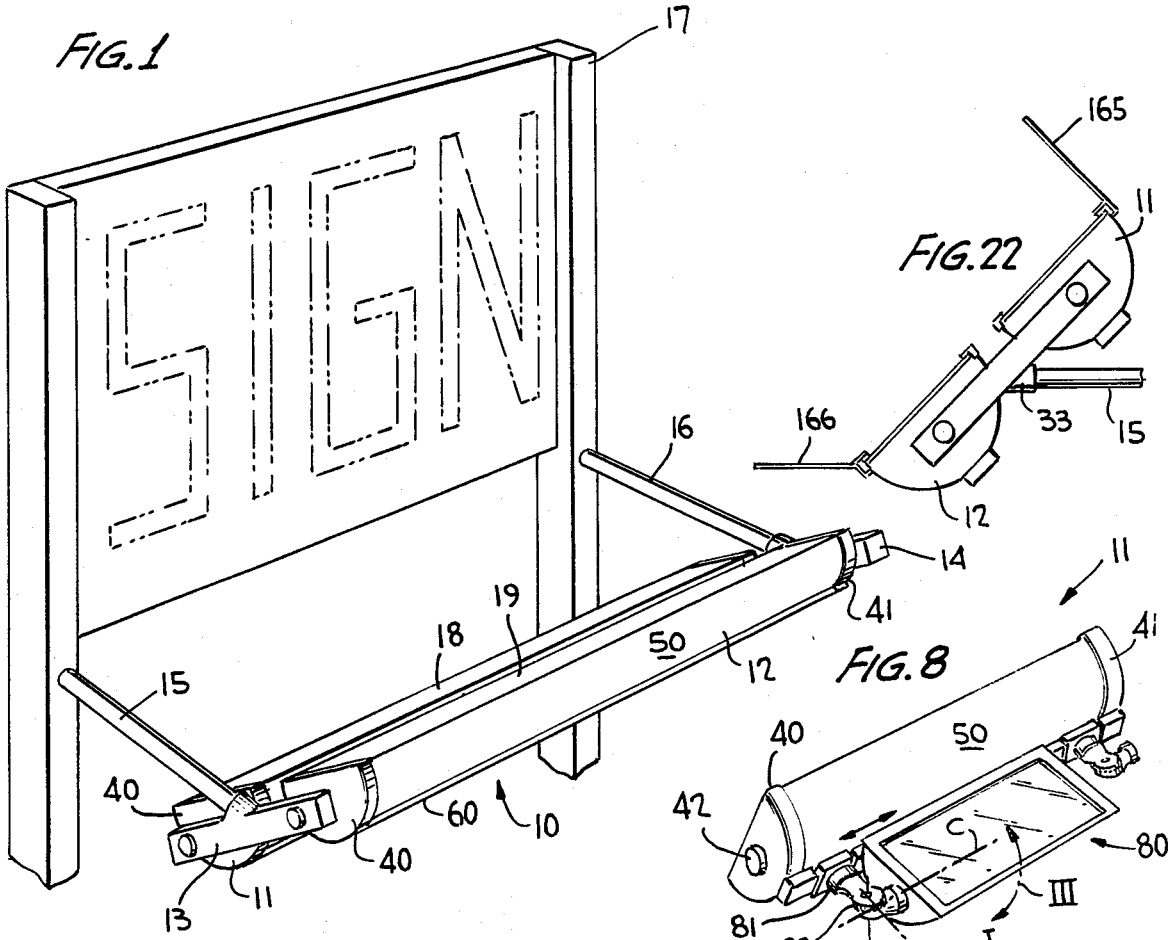
FIG. 22
FIG. 8
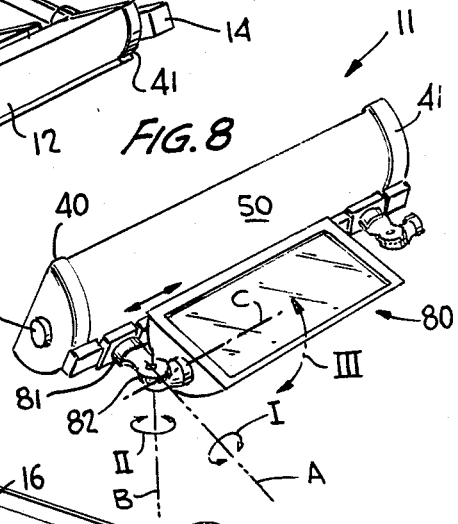
FIG. 2
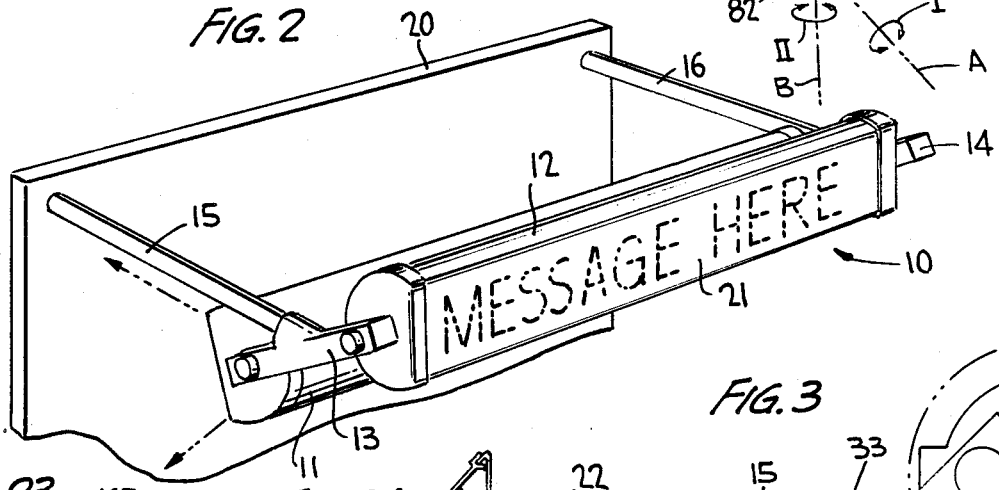
FIG. 3
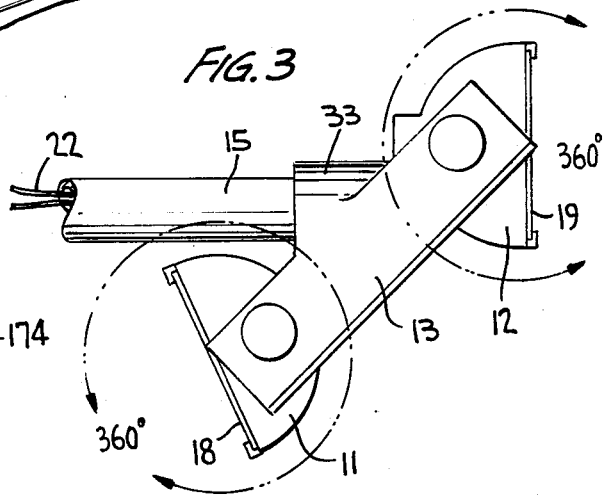
FIG. 23
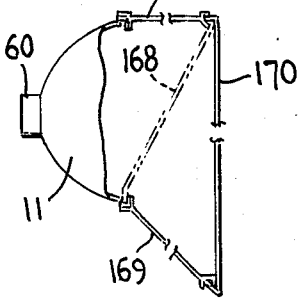
FIG. 24
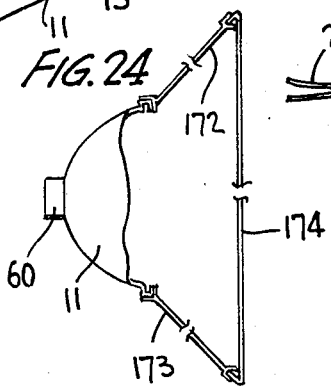

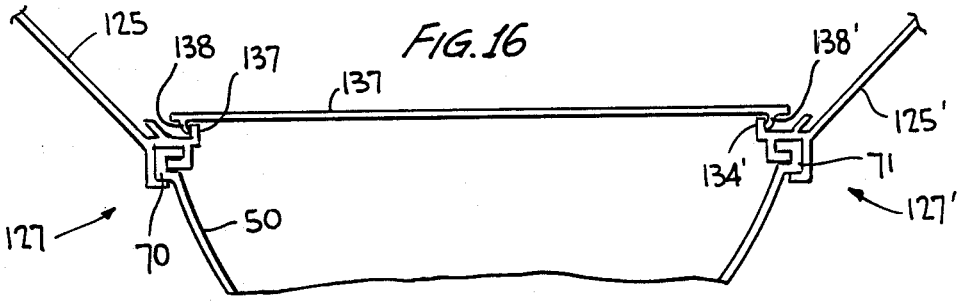
FIG. 16
125
138
137
137
138'
125'
134'
71
127'
127
70
50
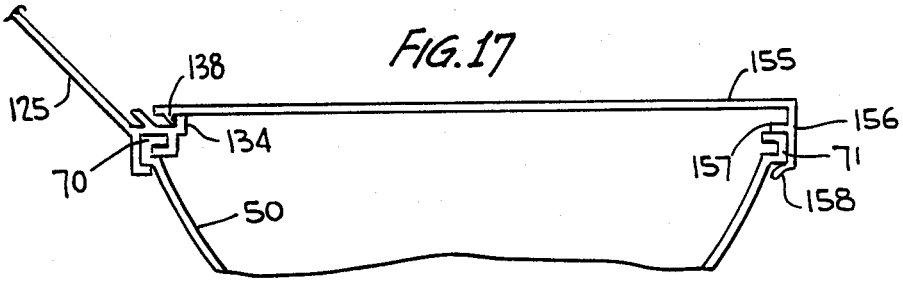
FIG. 17
138
155
125
156
134
157
71
70
158
50
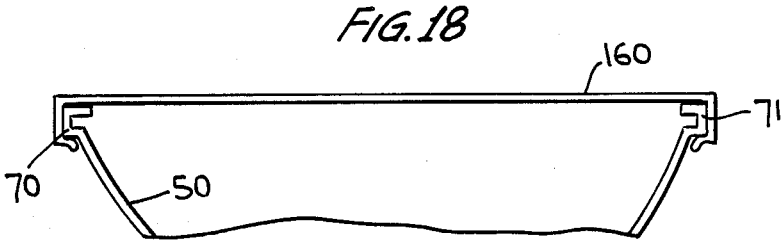
FIG. 18
160
71
70
50
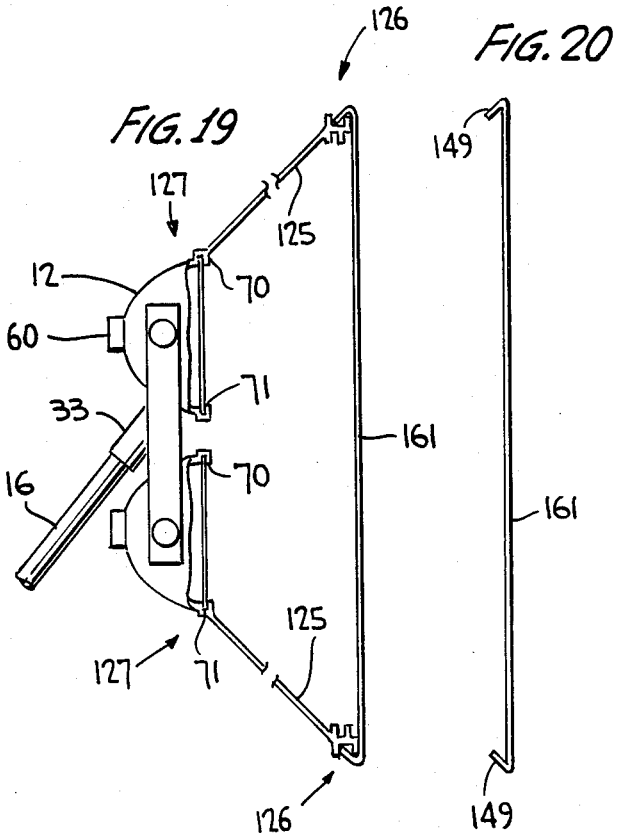
126
FIG. 19
127
125
12
70
60
71
33
161
16
70
125
127
71
126
FIG. 20
149
161
149
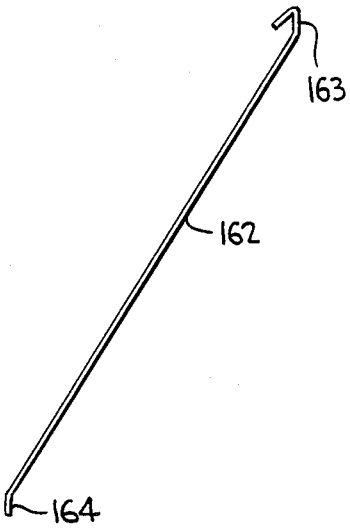
FIG. 21
163
162
164

ADJUSTABLE LIGHTING ASSEMBLY

BACKGROUND OF THE INVENTION

1. Technical Field

The present invention relates to lighting assemblies in which one or more fixtures are positionally and/or structurally adaptable to provide optimal selection of desired illumination patterns. In its more specific aspects the present invention relates to mounting arrangements permitting adjustable mutual positioning of two or more reflected linear lighting fixtures, and to mounting arrangements for deflectors and diffusers on such fixtures.

2. Discussion of the Prior Art

Although the present invention has some applicability to lighting fixtures in general, it is primarily concerned with mounting arrangements for "linear reflected lighting fixtures", used outdoors, to provide optimum adjustability of the illumination pattern or display produced by those fixtures. The phrase "linear reflected lighting fixtures" as used herein is intended to refer to an elongated or linear source or lamp mounted in an elongated reflector (e.g. having a semicylindrical, parabolic, or other cross-section) which intensifies and gives direction to the light emitted from the lamp. Examples of such linear reflected lighting fixtures may be found in U.S. Pat. Nos. 2,964,616 (Seidman) and 4,464,707 (Forrest), the disclosures of which are expressly incorporated herein, in their entireties by this reference.

Optimal positional adjustability of individual linear reflected lighting fixtures, in an assembly of such features, is desirable for various applications. For example, for street and area lighting it is desirable to permit the individual fixture positions to be mutually adjusted, after installation, to effect maximum illumination coverage from the assembly. For display illumination it is desirable to maximize visibility of the display. In the latter application, for example, there may be a need to illuminate a sign, such as a billboard, with a first fixture while also projecting light through a translucent sign covering the light-emitting opening of a second commonly mounted fixture. The billboard and translucent sign are usually required to face the same direction; however, the first fixture, in order to illuminate the billboard, must be oriented to face in some other direction that depends upon the structural mounting location of the fixture assembly. A most convenient positioning of the assembly for this application is to place the two fixtures with their linear axes in parallel and transversely-spaced relation, and to permit both fixtures to be selectively rotatable over a full 360° range in order to accommodate all possible mounting locations.

For many applications it is desirable to permit two linear reflected lighting fixtures, of the same or different length, to be assembled in a manner whereby a first fixture is secured to a second fixture so that the longitudinal axis of the first fixture can be positioned in substantially any orientation.

U.S. Pat. Nos. 4,204,274 (Luderitz) and 4,528,618 (Bitsch) disclose typical prior art lighting fixture assemblies in which two elongated lighting fixtures are mounted in spaced parallel orientation, and wherein both fixtures are rotatable about respective parallel axes. However, the very nature of the mounting or fixture structure in these assemblies precludes rotation of either fixture over a full 360 range. This severely limits the flexibility of these assemblies for optimal outdoor illumination and display applications. This limitation should not be surprising in view of the fact that both the Luderitz and Bitsch structures are designed for indoor use (i.e., as a wall light in a hospital room in the case of Luderitz, and as a desk or work table lamp in the case of Bitsch). I am unaware of any lighting assembly (for indoor or outdoor use) having two (or more) linear reflected lighting fixtures mounted so that either or both can be selectively rotatable about respective spaced parallel axes through a complete 360° range. Moreover, I am unaware of any such assembly, for outdoor illumination or display applications, having even the limited fixture positional flexibility achieved by the Luderitz and Bitsch indoor units.

As noted above, it is also desirable to provide optimal positional adjustable for linear reflected lighting fixtures in an assembly wherein the fixture axes are not necessarily in spaced parallel relation. This feature is desirable for many outdoor illumination and display applications. In U.S. Pat. No. 3,062,952 (Harling) there is disclosed an outdoor street lighting assembly wherein two elongated fixtures are mounted for selective individual rotation about respective intersecting axes. This fixed orientation of the rotational axes severely limits the flexibility of overall illumination patterns and, thereby, limits applications for which the Harling unit may be employed. Moreover, although the fixtures in the Harling unit might each be selectively rotated over a 360° range, the required intersecting orientation of the rotation axes precludes use of this unit for many display and illumination applications.

In addition to providing selectively variable illumination patterns by positionally adjusting individual fixtures, it is often desirable to selectively adjust the size of the light-emitting openings of linear reflected lighting fixtures used for display applications so that the size of the display sign may be changed as desired. It is also desirable to selectively adjust the directivity pattern of light emitted from a linear reflected lighting fixture, irrespective of the position of the fixture in an assembly or array of fixtures. To my knowledge, little or no attention has been given to these functions in the field of outdoor illumination and display lighting.

OBJECTS AND SUMMARY OF THE INVENTION

It is an object of the present invention to provide a mounting arrangement for linear reflected lighting fixtures in which at least two fixtures are selectively rotatable over a full range of 360° about respective spaced parallel axes.

It is another object of the present invention to provide a mounting arrangement for linear reflected lighting fixtures in which a first such fixture is mounted on a second such fixture to be selectively rotatable about three mutually transverse axes as well as being translatable relative to the second fixture.

Yet another object of the present invention is to provide a linear reflected lighting fixture, with the capability of changing the size of its light-emitting opening and, thereby, permitting translucent signs of different sizes to be attached at that opening.

A further object of the present invention is to provide linear reflected lighting fixtures with the capability of having their emitted illumination patterns selectively adjusted for different applications and installations without re-positioning the fixtures.

In accordance with one aspect of the present invention, an end of each of two (or more) linear reflected lighting fixtures is secured to a hollow multi-angular accessory bracket adapted to be suspended from, or otherwise secured to, a wall, frame or other support. The bracket includes hollow cylindrical connectors of a first type, one for each fixture, projecting from one side of the bracket. An end of each fixture includes a hollow cylindrical connector of a second type, adapted to telescopically receive (or be telescopically received in) a mating connector of the first type. Each fixture may be independently rotated, relative to the bracket and the other fixture, about the coaxial axes of its mating connectors. The connectors projecting from the bracket have their axes oriented in spaced parallel relation, with the spacing being sufficient to permit each fixture to be selectively rotated through a 360° range without mutual interference between adjacent fixtures. A plurality of set screws are provided for each pair of mated connectors and extend radially through one connector to bear against the other so as to permit the connectors, and the fixture, to be selectively locked in any desired rotational position. The hollow bracket body and hollow connectors serve as conduits for electrical wiring extending between the fixtures and extending from the fixtures to other locations via the bracket.

According to a second aspect of the present invention, a first linear reflected lighting fixture is mounted on a second linear reflected lighting fixture so as to have maximum positional adjustability. The second fixture has, on the back side of its opaque casing, an elongated track projecting radially outward and extending lengthwise co-extensively with the casing length. A mounting adapter has a first end configured to engage, and be selectively translated along, the track, and a second end in the form of a hollow cylindrical connector of the aforesaid second type. A swivel unit includes two substantially identical swivel members engaged at one end for selective mutual rotation about a common swivel axes. The second end of each swivel member forms a hollow cylindrical connector of the aforesaid first type. One of the swivel members has its connector rotatably engaged with the connector of the adapter; the other swivel member has its connector rotatably engaged with a connector of the second type at one end of the first lighting fixture. The resulting assembly permits the first fixture to be selectively repositioned in four different degrees of motion relative to the second fixture, namely: (1) the swivel assembly can be selectively rotated through a range of 360° relative to the adapter unit about a first axis orientated perpendicular to the track length along the second fixture; (2) the two swivel members can be selectively mutually rotated through a 270° range about the swivel axis (i.e., a second axis) transversely oriented with respect to the first axis; (3) the first fixture can be selectively rotated through 360° range relative to the swivel assembly about a third axis transversely oriented with respect to the first and second axes; and (4) the adapter can be translated along the track at the back of the second fixture casing. The adapter and swivel members are hollow to serve as electrical wiring conduits. In addition, holes can be formed through the second fixture casing, at the track, to permit wiring to pass from the second fixture to the first fixture through the hollow mounting components. The two fixtures can be of the same or different lengths, and more than one fixture can be secured to the same track, at the back side of the second fixture, with the potential of four degrees of positional adjustability.

In accordance with yet another aspect of the present invention, the size of the light-emitting opening of a linear reflected lighting fixture is selectively changeable to permit translucent display signs of different size to be attached thereto, or to permit the use of different diffusers to change the direction and shape of the emitted illumination pattern. The light-emitting opening is defined between two linear mutually facing channels on opposite edges of the reflector opening so as to slidably receive or hingedly connect to a planar diffuser or translucent sign, or deflectors arranged to extend at substantially any angle from either or both channels. The deflectors are also provided with channels for slidably receiving a planar diffuser or translucent display sign. The sizes of the deflectors, and the angles at which the deflectors diverge/converge from the reflector edge, determine the size of the final light-emitting opening of the fixture as well as the directivity of the emitted illumination pattern.

BRIEF DESCRIPTION OF THE DRAWINGS

The above and still further objects, features and advantages of the present invention will become apparent upon consideration of the following detailed description of specific embodiments thereof, especially when taken in conjunction with the accompanying drawings wherein like reference numerals in the various figures are utilized to designate like components, and wherein:

FIG. 1 is a view in perspective of a first embodiment of the present invention in which two linear reflected lighting fixtures are mounted by means of a multi-angular accessory bracket which permits both fixtures to be selectively rotated through a range of 360° about respective spaced parallel axes, wherein both of the fixtures are shown positioned to illuminate a common display sign;

FIG. 2 is a view in perspective of an embodiment similar to that of FIG. 1 but wherein one fixture is shown illuminating a sign or area while the other fixture serves as a display fixture by transmitting light through a translucent sign secured at the light-emitting opening of the fixture;

FIG. 3 is a side view in elevation of the multi-angular accessory bracket employed in the embodiments of FIGS. 1 and 2, illustrating in diagrammatic fashion the rotational capabilities of two mounted linear reflected light fixtures;

FIG. 8 is a view in perspective of a second embodiment of the present invention in which a first linear reflected lighting fixture is mounted on a second linear reflected lighting fixture so as to have four independent degrees of selective positional adjustability;

FIG. 16 is a view in section showing another embodiment of a diffuser/translucent sign secured to the deflector of FIG. 13 which in turn is attached to the reflector of a linear reflected lighting fixture;

FIG. 17 is a view similar to FIG. 16 illustrating still another embodiment of a diffuser/translucent sign secured to a deflector-reflector assembly for a linear reflected lighting fixture;

FIG. 18 is a view similar to FIG. 16 illustrating still another embodiment of a diffuser/translucent sign secured to a reflector of a linear reflected lighting fixture;

FIG. 19 is a diagrammatic side view illustrating a diffuser/translucent sign secured to two deflectors projecting from respective linear reflected lighting fixtures mounted in accordance with the embodiment of FIG. 1;

FIG. 20 is a view in transverse section of an alternative diffuser/translucent sign that may be employed in place of the diffuser/translucent sign illustrated in FIG. 19;

FIG. 21 is a view in transverse section showing still another diffuser/translucent sign that may be employed in place of the diffuser/translucent sign of FIG. 19;

FIG. 22 is a side view in elevation diagrammatically illustrating two additional deflectors secured to the respective linear reflecting lighting fixtures of the embodiment of FIG. 1;

FIG. 23 is a side view in elevation and partial section showing how two different diffusers/translucent signs may be secured to a single linear reflected lighting fixture in accordance with the present invention; and FIG. 24 is a side view in elevation and partial section showing how a still further diffuser/translucent sign may be secured by means of deflectors to a linear reflected lighting fixture in accordance with the present invention.

DESCRIPTION OF THE PREFERRED EMBODIMENTS

Figures 4, 5, 6, 7:
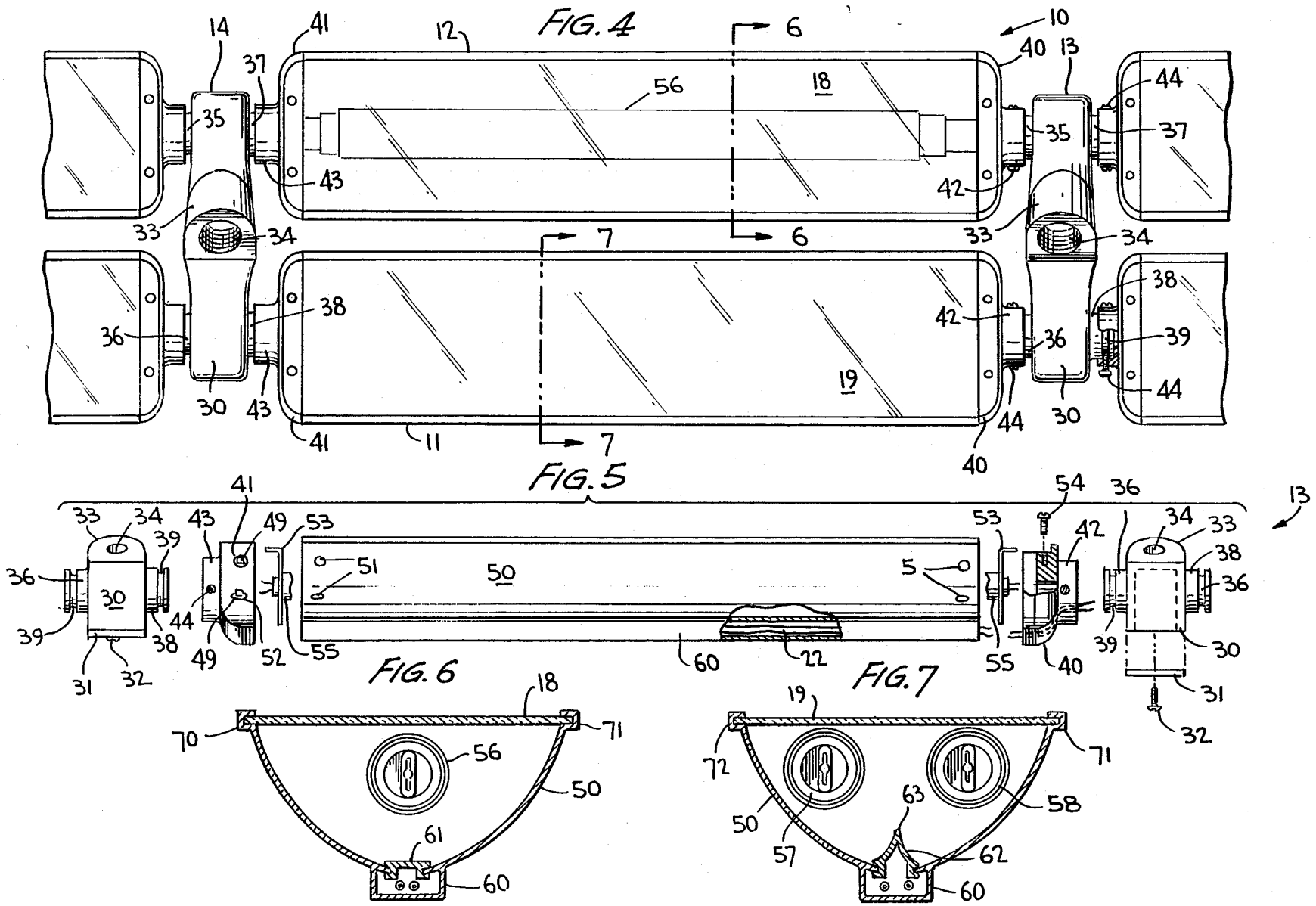
FIG. 4 is a front view in elevation of an assembly of lighting fixtures secured together by means of the multi-angular accessory bracket of FIG. 3 so as to permit selective rotation of each fixture through a 360° range.
FIG. 5 is a bottom view in plan, in partial section and partially exploded, of the assembly of FIG. 4.
FIG. 6 is a view in section taken along lines 6—6 of FIG. 4.
FIG. 7 is a view in section taken along line 7—7 of FIG. 4.

Referring specifically to FIG. 1 of the accompanying drawings, a lighting assembly 10 includes two linear reflected lighting fixtures 11 and 12 mounted by means of two multi-angular accessory brackets 13 and 14 and two mounting poles 15 and 16 to billboard 17. Both fixtures 11 and 12 are independently and selectively rotatable through 360° ranges about their respective longitudinal axes in a manner described below. The light-emitting opening of fixtures 11 and 12 are covered with ilumination diffusers 18 and 19, respectively. In the positions illustrated in FIG. 1, both fixtures are oriented to illuminate the sign on billboard 17; that is, the angular positions of the fixtures 11 and 12 have been chosen so that the diffusers 18 and 19 both face the billboard sign. Once the fixtures are so positioned, they may be selectively locked in place in a manner described herein. The fixtures themselves may be of the type illustrated and described in the aforementioned Forrest patent. Mounting poles 15 and 16 each have a proximal end secured to the billboard 17 and a distal end secured to a respective bracket 13 and 14. The lengths of the poles are selected for the particular installation; however, the positional versatility of fixtures 11 and 12 permits a wide variety of pole lengths to be employed and also provides leeway on positional placement of the poles at the billboard. In the embodiment of FIG. 1, the distal ends of poles 15 and 16 project forwardly of billboard 17 to suspend the lighting fixture assembly 10 at a location below and in front of the billboard. Given the rotational position adjustability of fixtures 11 and 12, however, it will be appreciated that the poles can be secured substantially anywhere along the billboard in order to optimize the suspension location of assembly 10 without blocking the illuminated sign from view. In other words, the mounting location may be moved up or down along the billboard, or the entire assembly may be rotated so that the poles 15 and 16 are vertically spaced at one side of the billboard, leaving the fixtures 11 and 12 in a vertical, rather than horizontal, orientation. Fixture orientations between horizontal and vertical are also possible, depending upon the mounting space available on the billboard for the proximal ends of the mounting poles 15 and 16.

To illustrate the versatility of the fixtures 11 and 12 in assembly 10, reference is made to FIG. 2 wherein the poles 15 and 16 are secured to a vertical display wall 20 with assembly 10 suspended above and in front of wall 20. Fixture 11 is provided with an illumination diffuser and is positioned to illuminate wall 20 which may be a display area. Fixture 12, instead of having an illumination diffuser disposed over its light-emitting opening, is provided with a translucent display sign 21. In order for the sign 21 to be seen together with the illuminated area on wall 20 by viewers facing wall 20, fixture 12 must be rotated to the position illustrated in FIG. 2 (i.e., facing in substantially the opposite direction from fixture 11). If it is later desired to remove sign 21 and illuminate wall 20 with both fixtures 11 and 12, sign 21 may be replaced with a diffuser, and fixture 12 may be rotated to the appropriate orientation to effect such illumination. This positional versatility is illustrated diagrammatical in FIG. 3 wherein it may be seen that fixtures 11 and 12 have their rotation axes in spaced parallel relation and are each selectively and independently rotatable through an entire 360° range about their respective axes. As is also evident in FIG. 3, electrical wiring can be run through the mounting poles 15 (and/or 16) to the multi-angular accessory bracket 15 (and/or 14) which is appropriately hollow to serve as a wire conduit. In this manner, the wiring may be passed via bracket 13 and/or 14 between the fixtures 11 and 12, and from either fixture to a remote location (e.g., a power supply) via the mounting poles 15, 16.

As best illustrated in FIGS. 4 and 5, multi-angular accessory brackets 13 and 14 are generally rectangular hollow box-like members. The bracket is preferably made from cast aluminum (although other metal or plastic material may likewise be employed) in two pieces: a first piece, consisting of the box-like member 30 having an open back; and a back cover plate 31 secured over the open back by means of screws 32 engaging tapped holes in member 30. The front of member 30 includes a projection 33 in which a tapped bore 34 is defined at an angle of approximately 45° relative to the front surface. Bore 34 in brackets 13 and 14 is adapted to threadedly engage the distal end of a respective mounting pole 15 and 16 (FIG. 1). Bore 34 opens into the hollow interior of member 30 to permit wiring carried within the mounting poles to be passed into the bracket. Four hollow cylindrical connectors of a first type project from the sides of member 30. More particularly, two connectors 35 and 36 of the first type project from one side of member 30 in spaced parallel relation; two connectors 37 and 38 of the first type project from the opposite side of member 30 in the same spaced parallel relation. Each connector 35, 36, 37, 38 has a circumferential recess 39 in its periphery at a location close to but axially displaced from the distal end of the connector. Connectors 35 and 37 are axially aligned on opposite sides of member 30; likewise, connectors 36 and 38 are axially aligned.

Each fixture 11, 12 has a pair of end plates 40, 41 disposed at opposite longitudinally-spaced ends, respectively, of the fixture. One hollow cylindrical connector 42 of a second type projects longitudinally of the fixture rotation axis from end plate 40; another hollow cylindrical connector 43 of the second type projects longitudinally of the fixture rotation axis from end plate 41 coaxially with connector 42. The connectors 42 and 43 of the second type have an inside diameter that is slightly greater than the outside diameter of the connectors 35, 36, 37, 38 of the first type so that the first type connectors can be telescopically received (i.e., longitudinally inserted) into the connectors of the second type in coaxial orientation. The common axes of each mated pair of connectors of the first and second types defines the rotation axis for a respective lighting fixture. Thus, connector 35 of bracket 13 is received in connector 42 for fixture 12 such that the connectors can be mutually rotated. Likewise, connector 37 of bracket 14 is received in connector 43 of fixture 12. Fixture 12 can thus be rotated relative to brackets 13 and 14 about a common axes defined by these four connectors. In a similar manner, connector 36 of bracket 13 rotatably mates with connector 42 of fixture 11, while connector 38 of bracket 14 mates with connector 43 of that fixture, thereby defining a common rotation axis for fixture 11 relative to the brackets.

Each pair of mating connectors is provided with a plurality of set screws 44 to permit the fixtures to be selectively locked in a desired rotational position or unlocked to permit rotation to a desired location. Specifically, set screws 44 are engaged in respective tapped bores extending radially through the larger connectors (i.e., connectors of the second type) 42, 43 at an axial location that permits the distal end of each set screw to project into the circumferential recess or slot 39 defined in the outer periphery of a mating connector 35, 36, 37, 38 of the first type. When the distal ends of the set screws 44 are fully inserted, they bear against the bottom surface of the slot 39 in at least two locations (i.e., if there are two screws; three locations if there are three screws), thereby preventing axial and rotational displacement between the mated connectors. If one or all set screws are loosened but not withdrawn entirely from slot 39, axial displacement is precluded but rotational displacement can occur. Under such circumstances the fixture can be rotated to a desired position. When all of the set screws are withdrawn completely from slot 39, both axial and rotational displacement is possible so that the fixture can be rotated with respect to, or withdrawn entirely from, the brackets.

As best illustrated in FIG. 5, end plates 40 and 41 are secured to each fixture by means of connecting screws 49 extending through holes 51 in the fixture reflector 50 and engaged by nuts 52 at the back surface of the reflector. Each end plate 40, 41 has a socket assembly 53 secured thereto by means of screws 54, or the like. In the case of fixture 12, each socket assembly includes a single socket member 55 configured to receive an end of a single linear lamp or light source 56 (as illustrated in FIGS. 4 and 6). These socket members (positioned at opposite ends of the single source fixture 12) are positioned to support the source 56 preferably concentrically about the fixture rotation axis (i.e., coaxially with connectors 42 and 43). In the case of fixture 11, each socket assembly 53 includes two socket members 55 to permit a pair of linear lamps or light sources 57, 58 to be supported between the fixture end plates 40, 41 as best illustrated in FIG. 7.

Referring to FIGS. 6 and 7, the reflector casing 50 is substantially identical in fixtures 11 and 12 and includes an elongated opaque sheet of aluminum (or other material) having a parabolic transverse cross-section. The interior or concave surface of the casing is reflectively coated to efficiently reflect light impinging thereon as part of the desired illumination emission pattern for the fixture. A longitudinally extending gap divides the reflective surface into two symmetrical halves and defines a recess or track 60 projecting radially outward from the convex or back surface of the casing. Track 60 is hollow and serves as a conduit for electrical wiring extending between the sockets at opposite ends of the fixture. The gap defined between the parabolic sections is closed by means of a slidably removable (i.e., when the end plates are removed) connecting strip 61 (for fixture 12, FIG. 6) or 62 (for fixture 11, FIG. 7). Connecting strips 61 and 62 are provided with longitudinal guide channels along their opposite sides to receive respective portions of the reflective half parabola that project over the gap formed by track 60. In the case of the single lamp fixture 12, strip 61 has a reflective interally-facing surface contoured to approximate a continuation of the parabolic reflecting surface at the gap. In the two-lamp fixture 11, strip 62 projects inwardly along two arcuate reflective surfaces intersecting at an apex 63 that is transversely centered with respect to lamps 57 and 58. Track 60 has a generally rectangular configuration and, in addition to serving as a wiring conduit, can provide a mounting function in a manner described in relation to the embodiment illustrated in FIGS. 8 and 9.

The light-emitting opening for reflector 50 is defined between two longitudinally-extending channels 70 and 71 disposed along the edges of the reflector and opening inwardly to face one another across the opening. Channels 70, 71 serve as tracks for slidably receiving diffusers 18, 19 (or translucent sign 21) that function as covers for the light-emitting opening. The slidability for these covers, as provided by channels 70, 71, permits rapid interchangeability between diffusers and translucent signs, or between different types of diffusers, or between different signs. As illustrated in FIGS. 4 and 5, each bracket 13, 14 may support two fixtures on one side and two additional fixtures on the other side so that two elongated chains of such fixtures may be constructed as needed for different illumination and/or display applications. Unused connectors on any side of a bracket may be sealed with caps, or the like. Alternatively, brackets may be provided with connectors projecting from only one side. It will be appreciated that fixtures 11 and 12 need not be supported at both ends; that is, either of brackets 13 and 14 may be eliminated so that the fixtures 11 and 12 are rotatably supported on only one of those brackets. It will also be appreciated that brackets 13 and 14 need not be limited to supporting only two linear reflected lighting fixtures; rather, the bracket 13 can be extended in length so as to support any number of rotatable linear reflected lighting fixtures having their rotation axes in spaced parallel relation. The important point is that the connectors of the first type, which project from the side of the multi-angular accessory bracket 13 or 14, must be spaced sufficiently to provide complete clearance between adjacent lighting fixtures so that each fixture is free to rotate through an entire 360° range without contacting an adjacent fixture.

For many outdoor illumination and display applications, the multi-angular accessory bracket 13, 14 provides significant positional flexibility for two or more linear reflected lighting fixtures arranged with their rotation axes in spaced parallel relation. There are illumination and display applications, however, where the spaced parallel relationship is too restrictive. The embodiment illustrated in FIGS. 8, 9 and 10 addresses this problem. Referring specifically to FIG. 8, a linear reflected lighting fixture 80 is arranged to be mounted for substantially universal positional adjustability on the back of another linear reflected lighting fixture 11. The mounting arrangement for fixture 11 is not shown in FIG. 8 in order to simplify the illustration and an understanding of this embodiment of the present invention; it is assumed, however, that fixture 11 is supported in the manner illustrated in FIGS. 1 or 2, or in some other manner, and may itself be rotatable or not relative to its support. The important aspects of this embodiment of the invention relate to the positional adjustability of fixture 80 relative to fixture 11. Specifically, fixture 80 has four independent degrees of selectively positional adjustability relative to fixture 11. The mounting components that provide for these different degrees of positional adjustability are described in detail below in relation to FIG. 9; for purposes of FIG. 8, however, it is only important to note that fixture 80 is selectively rotatable about three mutually transverse axes, A, B and C, and is selectively translatable longitudinally of fixture 11. Axis A extends perpendicular to track 60 of fixture 11, and fixture 80 is selectively rotatable in both directions through a 360° range about axis A, as diagrammatically represented by arrow I. Axis B is spaced from track 60 of fixture 11 and perpendicularly intersects axis A; arrow II illustrates the rotatability of fixture 80, in both directions, over a full 270° range about axis B. Axis C perpendicularly intersects axes A and B and is also spaced from track 60 of fixture 11; arrow III illustrates the 360° rotatability in both directions of fixture 80 about axis C. Arrow IV illustrates the translational adjustability of fixture 80 along track 60 of fixture 11. It will be appreciated from the following disclosure that intersection of the three axes A, B and C, and intersection of axis A with track 60 of fixture 11, is a desirable feature in that the mounting components can be kept small and relatively simple to fabricate. However, actual intersection of the axes, and actual intersection of axis A with track 60 of fixture 11, should not be considered as a limiting feature of the present invention. In this regard, it is merely a matter of routine design to extend one or more mounting parts in a direction perpendicular to any of the axes so as to offset that axis from the intersection. What remains after the offset, however, is a mutually transverse relationship between all three axes and a transverse relationship between axis A and track 60 of fixture 11. The key feature then, is the fact that fixture 80 is selectively and independently rotatable, relative to fixture 11, about three mutually transverse (and not necessarily intersecting) axes, and is selectively translatable along a track extending transversely of (and not necessarily intersecting) one of those axes.

Fixture 80 is illustrated in FIG. 8 as being a linear reflected lighting fixture having a shorter length than linear reflected lighting fixture 11. It is important to note that fixture 80 can be substantially any length relative to fixture 11 and, in fact, need not be a linear reflected lighting fixture. It is also to be noted that more than one lighting fixture can be mounted for four degrees of selective positional adjustability on the same track 60 of fixture 11.

Figure 9:
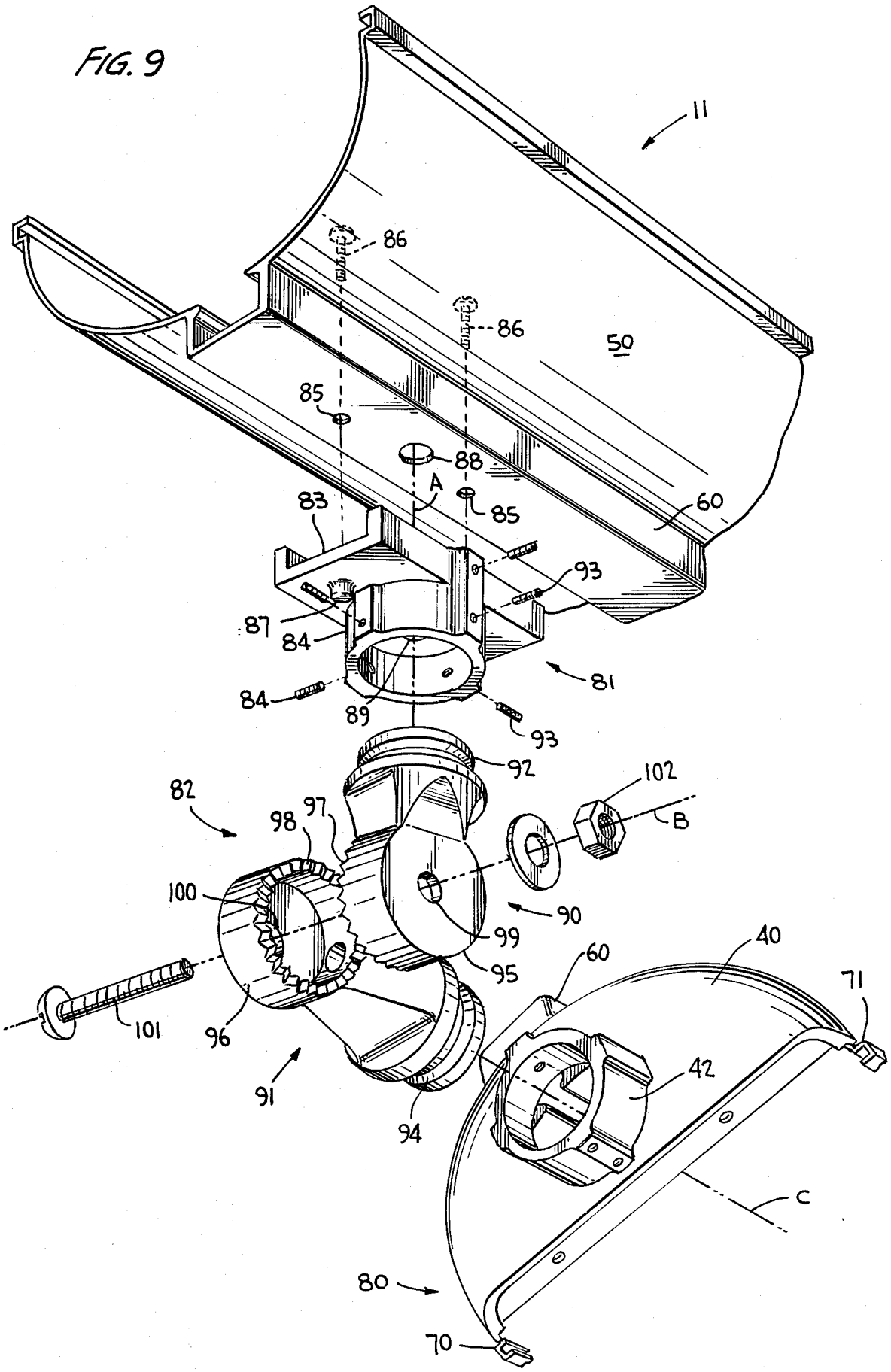
FIG. 9 is an exploded view in detail of the mounting arrangement for securing the linear reflected fixtures together in the embodiment of FIG. 8.

Referring specifically to FIG. 9, the mounting arrangement securing fixture 80 to fixture 11 for four degrees of mutual positional adjustability includes a slidable mounting adapter 81 and a swivel unit 82. Mounting adapter 81 has a first end in the form of a three-sided channel 83 of rectangular cross-section configured to slidably engage track 60 of fixture 11. The rectangular cross-section of channel 83 is important only because track 60 is rectangular; in other words, the transverse cross-sectional configuration of channel 83 is chosen to match the transverse cross-sectional configuration on the outside surface of track 60 so that the channel can receive the track anywhere along the length of the track. The opposite end of mounting adapter 81 is formed as a hollow cylindrical connector 84 of the aforesaid second type (i.e., the type provided on the fixtures 11, 12, rather than the type provided on the multi-angular accessory bracket 13, 14). Adapter 81 is selectively secured at a desired location along track 60 of fixture 11 by drilling, or otherwise forming, two longitudinally-spaced mounting holes 85 through the track 60 at the desired location, and inserting respective screws 86 through mounting holes 85 so as to be threadedly engaged in longitudinally-spaced tapped recesses 87 defined in the base wall of channel 83 on opposite longitudinal sides of connector 84. A conduit hole 88 is also formed between the two mounting holes 85 and registers with a conduit hole 89 defined in the channel base wall to communicate with the hollow interior of connector 84.

Swivel unit 82 comprises two substantially identical hollow swivel members 90 and 91. One end of swivel member 90 is defined as a hollow cylindrical connector 92 of the aforesaid first type (i.e., of the type projecting from multi-angular accessory bracket 13) and is adapted to be received in connector 84 of adapter 81 for selective rotation therein through an entire 360° range. The coaxial central longitudinal axes of mated connectors 84 and 92 define rotation axis A. These two connectors can be selectively mutually locked in place by means of plural set screws 93 in the manner described above. One end of swivel member 91 is defined as a hollow cylindrical connector 94 of the aforesaid first type and is adapted to be received in connector 42 of fixture 80 for selective rotation in that connector through an entire 360° range. The coaxial central longitudinal axes of mated connectors 94 and 42 define rotation axis C.

These two connectors can also be selectively mutually locked in place by means of set screws (not shown).

The opposite ends of swivel members 90 and 91 terminate in respective cup-like members 95 and 96 having respective angular rims 97 and 98 disposed in registered abutting relation. Extending circumferentially along each of rims 97 and 98 is a series of regularly spaced and radially-extending teeth oriented such that the teeth of each rim can be interposed between the teeth of the other rim to define multiple mutual angular positions of members 95 and 96. In this manner the teeth on rims 97 and 98 define multiple discrete mutual rotational positions of the swivel members 90 and 91. The bases of cup-like members 95 and 96 have respective holes 99 and 100 defined therein along the common central longitudinal axes of those members. A screw extends along that axis through holes 99 and 100 and members 95 and 96, and is threadedly engagable by a nut 101 to selectively lock the swivel members in any of its discrete mutual angular orientations. The common axes of cup-like members 95 and 96 defines rotation axis B. The range of discrete mutual angular positions between swivel members 90 and 91 is limited by mutual interference between connectors 92 and 94. Typically the range is approximately 270° and, in any event, should exceed 180° to be useful. The number of teeth defined on rims 97 and 98 can be selected to provide the desired number of discrete angular orientations between the two swivel members; typically, there are approximately forty-eight teeth on each rim The teeth preferably have a V-shaped transverse cross-section with a slightly rounded apex to facilitate mutual rotation after nut 101 has been loosened on screw 100.

Although the exploded representation of the mounting arrangement components in FIG. 9 somewhat distorts the relative positions of axes A, B and C, it will be appreciated, as noted above, that in the preferred embodiment of the present invention the axes A and B perpendicularly intersect one another, axes B and C perpendicularly intersect one another, and axis A perpendicularly intersects track 60 on fixture 11. It is also to be noted, however, that it is the mutual transverse relationship between all of these axes, and between axis A and the track 60, that is important for purposes of the present invention; intersection of the axes, or of axis A with track 60, is not crucial.

Figure 10:
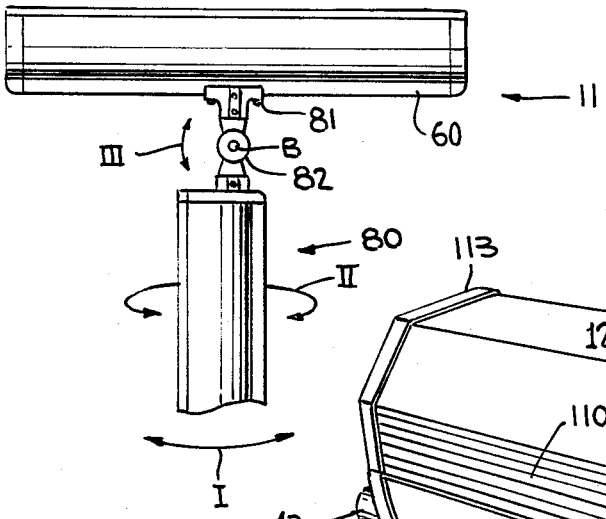
FIG. 10 is a front view in elevation of the assembly of FIG. 9.

The number of available positions of fixture 80 relative to fixture 11 approaches infinity. Adapter 81 can be positioned anywhere along the length of track 60 of fixture 11. Swivel unit 82 and fixture 80 can be rotated to any position within a complete 360° range about axis A. Swivel member 91 and fixture 80 can be rotated to any of the discrete positions about axis B permitted by the inter-engaged teeth on rims 97 and 98. Fixture 80 can be rotated to any position within a range of 360° about axis C. Thus, for example, as illustrated in FIG. 10, fixture 80 can be oriented with its length dimension extending perpendicular to the length dimension of fixture 11 by simply rotating the two swivel members 90 and 91 relative to one another to achieve that desired orientation. The desired orientation, of course, is determined by the illumination and/or display lighting requirements of any given application.

As illustrated in FIG. 8, plural mounting adapters, in combination with respective swivel units, can be mounted on a single track 60 of a fixture 11 so that plural respective fixtures 80 can be secured to fixture 11 in a manner to provide the aforesaid four degrees of positional adjustability.

The linear reflected lighting fixtures 11, 12 described above may be fitted with a variety of alternative diffusers, deflectors, covers and/or translucent signs. For example, referring to FIG. 11, a fixture 12 is provided with a pair of planar deflectors 110 (only one deflector being visible in FIG. 11) which diverge from respective channels 70, 71 (only channel 70 being visible in FIG. 11) at the longitudinally-extended edges of reflector 50. Deflectors 110 are preferably rectangular sheets of extruded aluminum having a length co-extensive with reflector 50. The width of the deflector panel can vary as required for different illumination/display applications. The inside surface of the deflectors is highly reflective to redirect the light impinging thereon from the lamp or source. This redirected light forms part of the overall illumination pattern from fixture 12 in combination with the light reflected from the interior surface of reflector 50 and light emitted directly from the lamp through the final fixture opening. Divergence of the deflectors 110 is referenced to an imaginary plane dividing the fixture 12 into two symmetrical longitudinal-extending halves. As described below, deflectors of different divergence angles can be chosen for specific applications; for present purposes it is important to understand that the divergence provided by deflectors 110 effectively widens, in a transverse direction, the final light-emitting opening of the fixture This feature can be used to provide a larger diffuser (i.e., for illumination) or a larger translucent sign In the embodiment illustrated in FIG. 11, a four-paneled diffuser 111 is secured between the distal longitudinally-extended edges of deflectors 110. Diffuser 111 is preferably made of vandal-resistant transparent material, such as polycarbonate material of the type sold by General Electric under the mark Lexan. End plates 112, 113 are provided at the edges of the joined deflectors 110 and diffuser 111 to seal the interior of the enlarged fixture The manner in which deflectors 110 can be selectively secured to and removed from reflector 50 is illustrated in FIG. 12 to which specific reference is now made. Along its two longitudinally-extending edges, each deflector 110 is provided with two substantially identical slide members 113, 114 formed integrally with the deflector. Slide members 113, 114 each include a tongue section 115 configured to be slidably received in either U-shaped channel 70, 71 located along the distal edges of reflector 50. The distal edge of tongue section 115 projects into U-shaped channel 70; the proximal edge of the tongue section perpendicularly joins a lip cover section 116 which, in turn, perpendicularly joins a side cover section 117. In this manner, sections 115, 116 and 117 define a slot which slidably receives, and is wrapped about, the distal sidewall of channel 70. Side cover section 117 perpendicularly joins a base cover section 118 extending along the base of channel 70 and perpendicularly joining a lip section 119 extending along the outside of the proximal wall of channel 70. Lip section 119 extends in a direction precisely opposite to that of tongue section 115 and is transversely spaced from the tongue section 115. Slide member 114, therefore, is configured to project into, and to be wrapped around, channel 70 while slidably engaging that channel longitudinally of the fixture The panel portion of deflector 110 is integrally joined to slide member 114 at the outside junction of side cover section 117 and base cover section 118.

Slide member 113 is identical to slide member 114 and slidably engages diffuser 111 along mutually adjacent longitudinally-extending edges of deflector 110 and the diffuser. Engagement of diffuser 111 by slide member 113, however, differs from the engagement of track 70 by slide member 114. More particularly, the mating edge of the diffuser is provided with a bent elongated lip 120 configured to fit between and be slidably engaged by lip section 119 and tongue section 115 of slide member 113. Importantly, the same slide structures 113 and 114 are thus configured to engage either a reflector edge channel 70, 71 or a diffuser lip 120.

Figure 11:
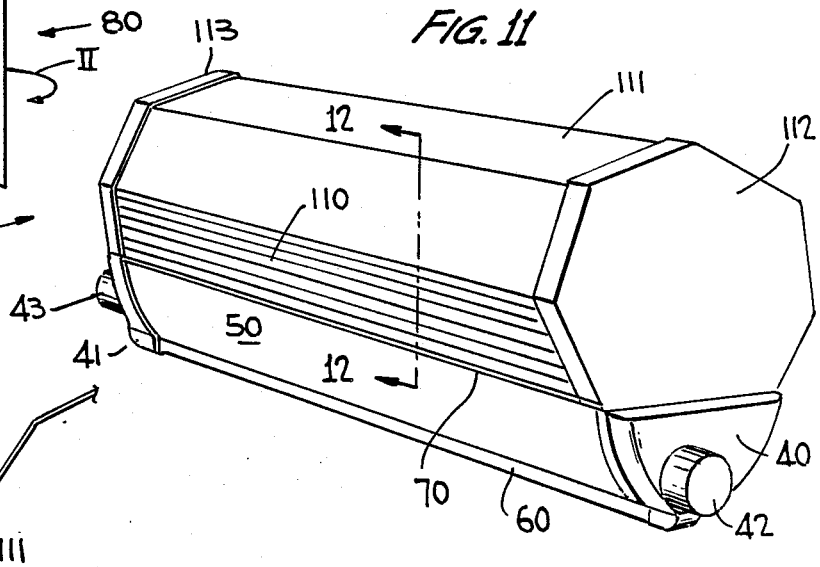
FIG. 11 is a view in perspective of a linear reflected lighting fixture utilized in the present invention and having attached thereto a deflector and diffuser having a first configuration.
Figure 12:
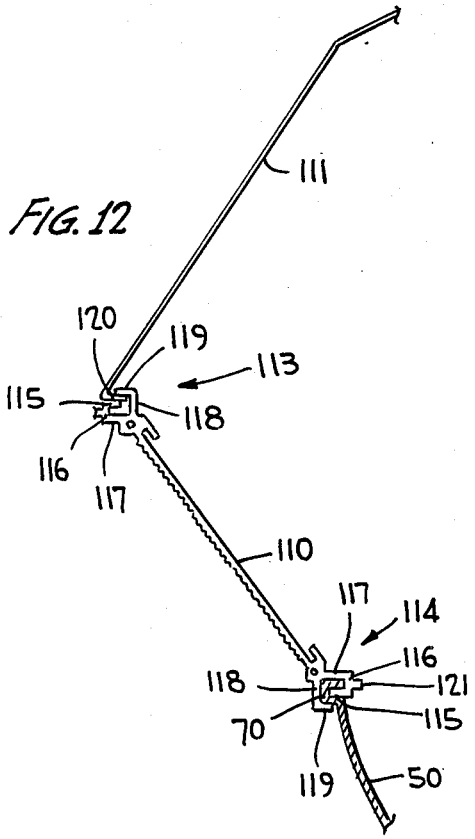
FIG. 12 is a detailed view in partial section taken along lines 12—12 in FIG. 11.

It will be appreciated, when examining FIGS. 11 and 12, that the effect produced by deflectors 110 on the final size of the light-emitting opening of the enlarged fixture depends upon: (1) the width of the deflector (i.e., the dimension between slide members 113 and 114); and (2) the divergence angle between base cover section 118 and the panel portion of deflector 110. For any given divergence angle, the light-emitting opening can be made larger by choosing the deflector to have a greater width or transverse dimension For any given transverse dimension of the deflector, the opening can be made larger by choosing a deflector with a greater divergence angle.

Each slide member 113 and 114 additionally includes a short ledge section 121 projecting perpendicularly outward from the base cover section 116. In the case of slide member 113, ledge section 121 may be used, in cooperation with a corresponding ledge section of a slide member disposed on the opposite edge of the fixture (not shown), to support a snap-on or slidable flat diffuser, cover or translucent sign.

Figure 13:
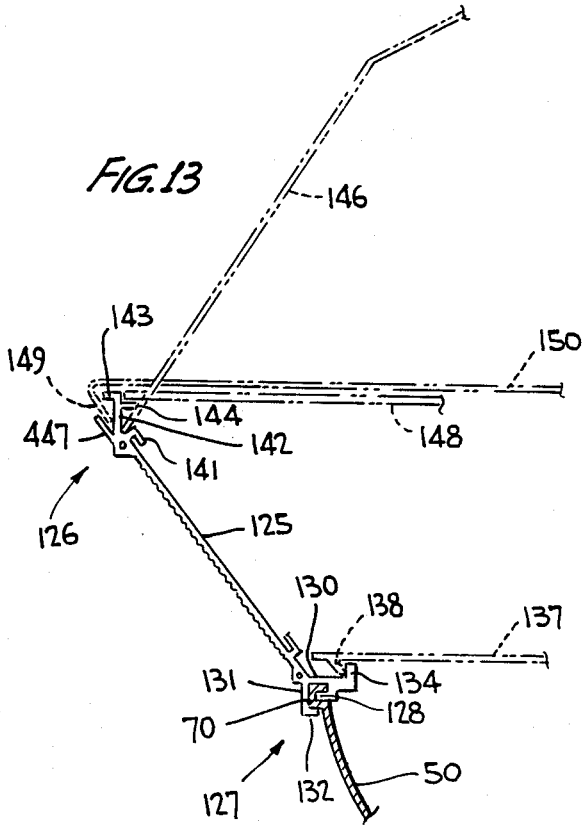
FIG. 13 is a view similar to FIG. 12 and illustrating a modified form of a deflector and a diffuser/translucent sign secured thereto.
Figure 15:
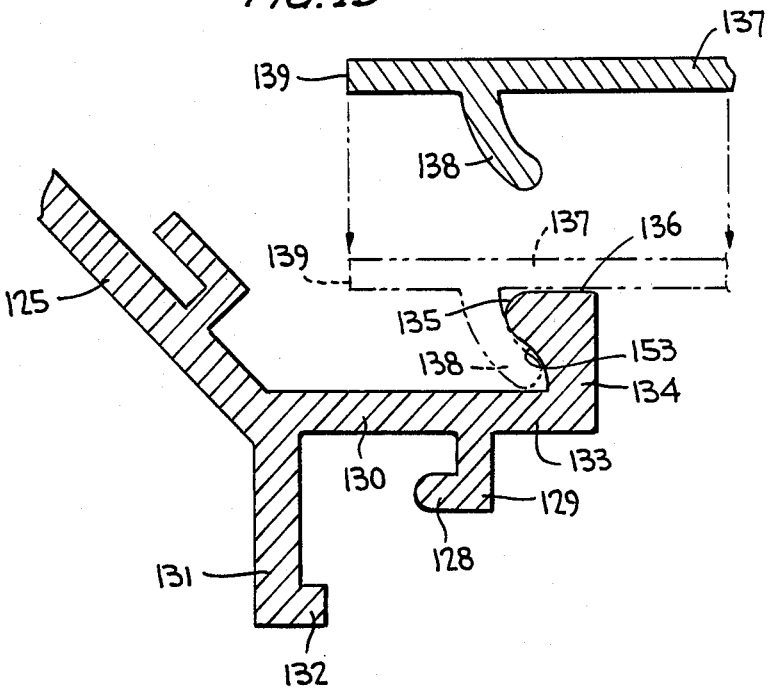
FIG. 15 is a view in transverse section of the opposite edge of the deflector employed in the embodiment of FIG. 13.

The slide members disposed along the edges of the deflector may have a modified configuration of the types illustrated in FIG. 13 so as to be adaptable to engage an even broader range of diffusers, covers, signs, etc. Referring to FIG. 13, a deflector 125 is substantially similar to deflector 110 but has differently configured slide members 126, 127 extending along its opposite longitudinally-extending edges. Slide member 127, illustrated in detail in FIG. 15, is adapted to engage channel 70 of reflector 50 in the same manner as slide member 114, and similarly includes a tongue section 128, a lip cover section 129, a side cover section 130, a base cover section 131 and a lip section 132. All of these sections correspond substantially to the similarly named sections in slide member 114, although lip cover section 132 is shorter than lip cover section 119 and need not extend as far as the distal end of tongue section 128. The panel portion of deflector 125 likewise extends from the junction of side cover section 130 and base cover section 131 to define the divergence angle as in deflector 110.

Side cover section 130 is provided with a straight extension 133 at its junction with lip cover section 129. Extension section 133 terminates in a support section 134 extending perpendicularly in a direction opposite to that of the lip cover section 129. The surface 153 of support section 134 facing back toward the panel portion of deflector 125 is arcuately contoured, diverging from the junction of sections 133 and 134 at a rate which first increases with displacement from section 133 and then decreases to define a rounded edge 135 comprising a smooth transition with the distal side 136 of section 134. It is to be understood, of course, that all of the elements in FIG. 15 are formed integrally with the deflector and are shown in transverse section, and that each element extends longitudinally into the plane of the drawing over substantially the entire length of the fixture.

As illustrated in both FIGS. 13 and 15, support section 134 and its contoured components 153, 135 and 136 permit a display sign, cover or diffuser 137 to be secured to slide member 127. Specifically, cover/sign/diffuser 137 is a generally rectangular translucent or transparent panel adapted to cover the fixture opening between slide members 127 disposed on opposite sides of the fixture. A clip 138 extends the entire length of the sign/cover/diffuser along one surface (i.e., the bottom surface in FIGS. 13 and 15) at a location displaced slightly inwardly from the longitudinally-extending edge 139 of the sign/cover/diffuser. A similar clip may be symmetrically positioned inboard from the opposite edge of the sign/cover/diffuser. Clip 138 is arcuately contoured to mate with the arcuate side 153 of support section 134. In this regard, sign/cover/diffuser 137 may be made of a somewhat resilient plastic material so that it can be flexed about its longitudinal center line (i.e., extending into the plane of the drawing in FIGS. 13 and 15) so that the sign/cover/diffuser can be snapped onto the slide member(s) 127 by engaging clip(s) 138 with support section(s) 134. Alternatively, the sign/cover/diffuser 137 may be longitudinally slid into place to likewise engage clips 138 from one end of the fixture.

Figure 14:
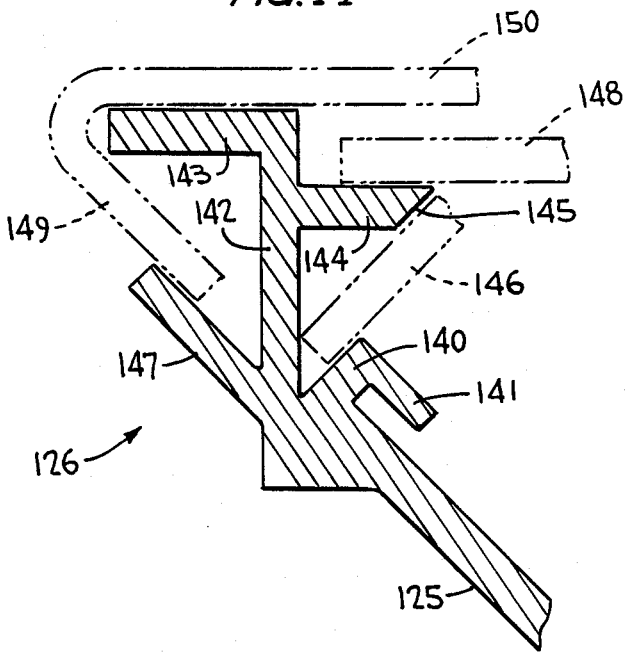
FIG. 14 is a view in transverse section of one edge of the deflector employed in the embodiment of FIG. 13.

As illustrated in FIGS. 13 and 14, slide member 126 is uniquely contoured to receive a wide variety of types of display signs, covers, diffusers, or the like. Specifically, the panel portion of deflector 125 terminates in a ledge section 140 extending a short distance perpendicularly of the panel and inwardly of the fixture. Ledge section 140, in turn, terminates in an interior section 141 oriented perpendicular to section 140 and extending a short distance back along the panel in spaced relation thereto The distal or outwardly-facing surface of ledge section 140 has an elongated support section 142 extending therefrom in a direction parallel to the imaginary plane that divides the fixture, at its central longitudinal axis, into two symmetrical halves. The angle subtended by sections 140 and 142 is determined by the divergence angle of the panel of deflector 125; since ledge section 140 is perpendicular to the panel, the subtended angle is complementary to the divergence angle. Support section 142 terminates in a flange section 143 extending perpendicular to and outwardly from section 142. At an intermediate location along the length of support section 142 there is provided a stabilization section 144 extending perpendicular to and inwardly from section 142. The distal edge 145 of section 144 is contoured along a bias oriented parallel to ledge section 140. The spacing between edge 145 and the ledge section 140, in the dimension perpendicular to these elements, is sufficient to permit the thickness dimension of a fixture cover, diffuser or sign 146 to fit and be supported therebetween. Alternatively, a display sign/cover/diffuser panel 148 may be supported on the side of stabilization section 144 facing outwardly of the fixture (and on a similar side of a stabilization section, not shown, on the other side of the fixture).

An engagement section 147 extends generally outwardly from the proximal end of the support section 142 in a direction parallel to the panel of diffuser 125. Sections 142, 143 and 147 define a three-sided outwardly-facing channel adapted to receive a bent lip portion 149 of a diffuser/cover/sign 150. Specifically, diffuser/cover/sign 150 is a generally rectangular member having its longitudinal edges bent downwardly and inwardly of the fixture to form an angle corresponding to the angle between engagement section 147 and flange section 143, or, otherwise stated, complementary to the angle between sections 147 and 142 (i.e., the divergence angle for the deflector). The bend 149 of diffuser/-cover/sign 150 may be snapped into place between sections 143 and 147, or it may be longitudinally slid into position between those sections from the end of the fixture. Again, it is understood that all of the elements in FIG. 14 are formed integrally with the deflector and are shown in transverse section, and that each element extends longitudinally into the plane of the drawing for the entire length of the fixture.

Referring to FIG. 16, the cover/diffuser/sign 137 of FIG. 15 is shown in snap-fit engagement with two parallel slide members 127 and 127'. Specifically, the two clips 138 and 138' extending longitudinally along the bottom of the cover/sign/diffuser 137 are engaged by respective support sections 134 and 134'. The two slide members 127 and 127' also engage respective channels 70 and 71 extending along respective sides of reflector 50.

For some applications it may be desirable to provide a deflector only along one edge of a fixture and still provide a cover/diffuser/sign for the fixture of the same general type as cover/diffuser/sign 137. An embodiment of this type is illustrated in FIG. 17 wherein deflector 125 is secured to channel 70 but no deflector is secured at channel 71. Diffuser/cover/sign 155 engages slide member 127 in the same manner described above; that is, clip 138 engages support section 134. The other longitudinally-extending edge of the diffuser/cover/-sign 155, however, is provided with a perpendicularly depending portion 156 from which two spaced members 157, 158 extend perpendicularly inwardly to define an outer channel contoured to receive the periphery of channel 71. The outer channel defined by members 157 and 158 is spaced rearwardly from the panel portion of the diffuser/cover/sign 155 in order to correspond to the displacement of the panel portion from channel 70 caused by the slide member 127 on the opposite side of the fixture. For applications wherein no deflectors are employed with the fixture, the diffuser/cover/sign 160 may have both sides bent downwardly and inwardly to define respective outer channels contoured to snap-fit over respective channels 70, 71 of the fixture as illustrated in FIG. 18.

The various deflectors described herein, and the manner in which they are secured to individual lighting fixtures, permits selective modification of the fixtures to increase the size of the light-emitting opening and/or vary the directivity of the pattern of illumination emitted from the fixture. Moreover, the same fixture is rendered adaptable, with or without the deflectors, for use with different types of covers/diffusers and display signs. To illustrate further flexibility permitted by these elements, reference is made to FIG. 19 wherein an assembly of the type illustrated in FIG. 1 is modified so that a single cover/diffuser/sign 161 may be employed for both fixtures 11 and 12. Specifically, the two fixtures 11 and 12 are fixed in rotational positions such that both fixtures face the same direction. In this orientation channel 70 of fixture 11 is disposed proximate channel 71 of fixture 12, whereas channel 71 of fixture 11 is remotely spaced from channel 70 of FIG. 12. It is only these remotely spaced channels to which respective deflectors 125 are secured by means of slide members 127. Deflectors 125 diverge from one another and terminate in respective slide members 126 of the type described above in relation to FIG. 14. Diffuser/cover/sign 161, of the same general type as diffuser/cover/sign 150 illustrated in FIG. 14, is snap-fit or slidably or hingedly engaged to the two slide members 126. The diffuser/-cover/sign 161, illustrated in greater detail in FIG. 20, includes bent lip portions 149 at its longitudinal edges, each bent lip portion being snap-fit or slidably engaged in the channel defined between sections 147, 142 and 143 in each of the slide members 126. As an alternative to diffuser/cover/sign 161, the diffuser/cover/sign 162 of FIG. 21 may be utilized in connection with the fixture assembly in FIG. 19. Under such circumstances the deflector 125 secured to fixture 11 would be removed. Accordingly, one end 164 of diffuser/cover/sign 162 is bent to be received in channel 71 of fixture 11. The diffuser/cover/sign 162, instead of extending parallel to the planes defined by the four channels 70 and 71, extends at an angle so as to be engaged in the slide member 126 of deflector 125 secured to fixture 12. The resulting orientation of diffuser/cover/sign 162, as determined by the transverse dimension (i.e., in the plane of the drawing) of the deflector 125, requires an appropriate modification of the bent portion 163 along the opposite side of diffuser/cover/sign 162 so that this bent portion may be accommodated between elements 142, 143 and 147 (FIG. 14).

As illustrated in FIG. 22, the deflectors employed in connection with one or more fixtures need not diverge at the same angle. For example, deflector 165 in FIG. 20 has a zero divergence angle; deflector 166 has some positive angle of divergence. A suitable diffuser/-cover/sign may be secured to the distal edges of these deflectors in the manner described above. In FIG. 23 a single fixture is shown with a deflector 167 having a zero divergence angle. A diffuser/cover/sign 168 may be used in connection with that deflector 167 and the absence of a deflector along the opposite edge of the fixture. Alternatively, a second deflector 169 may be employed and subtend a positive divergence angle; the resulting diffuser/cover/sign 170 is considerably larger and oriented at an entirely different angle than diffuser/cover/sign 168.

FIG. 22 illustrates a single linear reflecting lighting fixture 11 in which two diverging deflectors 172, 173 are employed to enlarge the effective light-emitting opening from the fixture, which opening is covered by a single diffuser/cover/sign 174.

The angle subtended by the various deflectors 110, 125, etc. and the longitudinal reference plane of symmetry for the fixture has been described herein as a "divergence angle". That angle may, of course, be positive (i.e., diverging), zero (k.e., neither diverging or converging), or negative (i.e., converging), depending upon the particular application for the lighting assembly/fixture.

From the foregoing description it will be appreciated that the invention makes available a novel lighting assembly in which one or more fixtures are positionally and/or structurally adaptable to provide optimal selection of desired illumination and/or display patterns.

Having described preferred embodiments of a new and improved lighting assembly constructed in accordance with the present invention, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What I claim is:

1. A lighting assembly comprising:

first and second lighting fixtures each having a longitudinal dimension and a transverse dimension, said fixtures each having an elongated light source extending in said longitudinal dimension and a longitudinal axis;

securing means for securing said first and second fixtures with their longitudinal axes parallel and in fixed transversely-spaced relation, said securing means comprising: first adjustment means permitting selective angular positioning of said first fixture about its longitudinal axis over a full 360° range independently and regardless of the angular positioning of said second fixture about its longitudinal axis; and a second adjustment means permitting selective angular positioning of said second fixture about its longitudinal axis over a full 360° range independently and regardless of angular positioning of said first fixture about its longitudinal axis;

wherein said securing means is a mounting bracket comprising a body portion with a hollow interior and at least a first wall, and first and second bracket connectors disposed on said first wall facing in the same direction;

wherein said first and second fixtures each include first and second longitudinally-spaced ends, said first end having a hollow fixture connector adapted to telescopically engage a respective bracket connector on said mounting bracket in concentric relation about said longitudinal axis to permit mutual rotation between the engaged fixture connector and bracket connector about said longitudinal axis;

wherein said first and second bracket connectors are mutually spaced sufficiently, with respect to the transverse dimension of said fixtures, to prevent mutual interference between said first and second fixtures for all possible combinations of angular positions of said first and second fixtures; and wherein said securing means further includes locking means for selectively locking each bracket connector to its telescopically engaged fixture connector to preclude mutual rotation therebetween.

2. The assembly according to claim 1 wherein said first and second fixtures are longitudinally co-extensive and wherein said second end of each fixture includes a hollow fixture connector substantially identical to and coaxially aligned with the fixture connector at said first end;

wherein said body portion of said mounting bracket includes a second wall opposite said first wall with third and fourth hollow bracket connectors disposed on said second wall facing a further direction opposite said same direction, said third and fourth bracket connectors being coaxially aligned with said first and second bracket connectors, respectively; and wherein said securing means further includes a second mounting bracket substantially identical to said first mounting bracket and positioned adjacent the second ends of said first and second fixtures such that said third and fourth bracket connectors of the second mounting bracket telescopically engage the fixture connectors at said second ends of said first and second fixtures, respectively, for mutual rotation about said longitudinal axes.

3. The assembly according to claim 2 further comprising electrical wiring extending through said hollow body portion and said bracket and fixture connectors for supplying energizing current to said elongated light sources.

4. The assembly according to claim 2 further including support means comprising:

a structural support; and first and second elongated hollow support members each having a first end adapted to be fixedly positioned on said structural support and a second end for engaging said first and second mounting brackets, respectively, such that said mounting brackets and lighting fixtures are suspended by said support members at a location displaced from said support structure.

5. The assembly according to claim 4 wherein said support means further includes, in each of said mounting brackets, a tapped bore defined in said body portion and extending in a plane perpendicular to the longitudinal axes of said first and second fixtures, wherein the second end of each hollow support member is threaded to be threadedly engaged in the tapped bore of a respective mounting bracket.

6. The assembly according to claim 5 further comprising electrical wiring extending through said hollow support members, said hollow body portions, said hollow bracket connectors and said hollow fixture connectors for supplying energizing current to said elongated light sources.

7. The lighting assembly according to claim 2 wherein said bracket connectors are hollow cylindrical sections of a first diameter, wherein said fixture connectors are hollow cylindrical sections of a second diameter, wherein said bracket and fixture connectors are axially telescopically engageable, one within the other, sand mutually rotatable, one within the other, and wherein said locking means includes means for selectively locking each engaged bracket connector and fixture connector in fixed mutual axial and angular orientations.

8. The lighting assembly according to claim 7 wherein said locking means comprises plural set screws for each pair of engaged bracket and fixture connectors, each set screw extending radially through one of the engaged connectors so as to selectively bear against the other of the engaged connectors.

9. The assembly according to claim 1 further including support means comprising:

a structural support;

an elongated support member having a first end adapted to be fixedly positioned on said structural support and a second end for engaging said first mounting bracket such that said mounting bracket and lighting fixtures are suspended by said support member at a location displaced from said support structure.

10. The assembly according to claim 9 wherein said support means further includes a tapped bore defined in said body portion and extending in a plane perpendicular to the longitudinal axis of said first and second fixtures, wherein the second end of said hollow support member is threaded to be threadedly engaged in the tapped bore of said mounting bracket.

11. The assembly according to claim 1 further comprising electrical wiring extending through said hollow body portion and said bracket and fixture connectors for supplying energizing current to said elongated light sources.

12. The lighting assembly according to claim 1 wherein said first fixture comprises:

an elongated reflector having a generally parabolic transverse cross section and first and second opposed longitudinally-extending channel-shaped edges defining a forward opening therebetween;

wherein said light source mounted within said reflector entirely rearward of said opening; and at least a first deflector in the form of a generally rectangular panel having a length that is longitudinally coextensive with said reflector and having a first longitudinally-extending edge in the form of a first slide member configured to slidably engage said first channel-shaped edge of said reflector.

13. The lighting assembly according to claim 12 wherein said first deflector has a second longitudinally-extending edge in the form of a second slide member, and further comprising a generally rectangular light-transmitting cover member longitudinally-coextensive with said reflector and having a first longitudinally-extending edge in engagement with said second slide member, and a second longitudinally-extending edge in engagement with said second channel-shaped edge of said reflector.

14. The lighting assembly according to claim 12 wherein said reflector is symmetrical about a reference plane bisecting said reflector into two longitudinally-extending halves, and wherein said deflector diverges from said reference plane in a direction forwardly of said reflector.

15. The lighting assembly according to claim 12 wherein said reflector is symmetrical about a reference plane bisecting said reflector into two longitudinally-extending halves, and wherein said deflector is substantially parallel to said reference plane.

16. The lighting assembly according to claim 12 further comprising a second deflector in the form of a generally rectangular panel having a length longitudinally co-extensive with said reflector and having a first longitudinally-extending edge in the form of a second slide member configured to slidably engage said second channel-shaped edge of said reflectors.

17. The lighting assembly according to claim 16 wherein said reflector is symmetrical about a reference plane bisecting said reflector into two longitudinally-extending halves, wherein said first and second deflectors each diverge from said reference plane and from one another in a direction forwardly of said reflector.

18. The lighting assembly according to claim 16 wherein said reflector is symmetrical about a reference plane bisecting said reflector into two longitudinally-extending halves, wherein said first deflector diverges from said reference plane in a direction forwardly of said reflector, and wherein said second deflector is substantially parallel to said reference plane.

19. The lighting assembly according to claim 16 wherein said first deflector has a second longitudinally-extending edge in the form of a third slide member, and wherein said second deflector has a second longitudinally-extending edge in the form of a fourth slide member, and further comprising a generally rectangular light-transmitting cover member longitudinally-extensive with said reflector and having a first longitudinally-extending edge in engagement with said third slide member, and a second longitudinally-extending edge in engagement with said fourth slide member.

20. The lighting assembly according to claim 12 wherein said second fixture comprises:

an elongated reflector having an arcuate transverse cross-section and first and second opposed longitudinally-extending edges defining a forward opening therebetween;

a light source mounted within said reflector rearwardly of said opening; and at least a second deflector in the form of a generally rectangular panel having a length longitudinally co-extensive with said reflector and having a first longitudinally-extending edge in the form of a second slide member configured to slidably engage said second channel-shaped edge of said reflector.

21. The lighting assembly according to claim 20 wherein said first deflector has a second longitudinally-extending edge in the form of a third slide member, wherein said second deflector has a second longitudinally-extending edge in the form of a fourth slide member, and further comprising a generally rectangular light-transmitting cover member longitudinally coextensive with said reflectors and having a first longitudinally-extending edge in engagement with said third slide member, and a second longitudinally-extending edge in engagement with said fourth slide member.

22. The lighting assembly according to claim 20 wherein said reflector is symmetrical about a reference plane bisecting said reflector into two longitudinally-extending halves, wherein said first and second deflectors each diverge from said reference plane and from one another in a direction forwardly of said reflector.

23. The lighting assembly according to claim 20 wherein said reflector is symmetrical about a reference plane bisecting said reflector into two longitudinally-extending halves, wherein said first deflector diverges from said reference plane in a direction forwardly of said reflector, and wherein said second deflector is substantially parallel to said reference plane.

* * * * *